US010398011B2

(12) United States Patent
Matilaine et al.

(10) Patent No.: US 10,398,011 B2
(45) Date of Patent: Aug. 27, 2019

(54) METHOD AND APPARATUS FOR ACTIVE FILAMENT MANAGEMENT

(71) Applicant: KIMTRON, INC., Oxford, CT (US)

(72) Inventors: John Matilaine, Armonk, NY (US); Jeffrey M. Pagini, Thomaston, CT (US)

(73) Assignee: KIMTRON, INC., Oxford, CT (US)

( * ) Notice: Subject to any disclaimer, the term of this patent is extended or adjusted under 35 U.S.C. 154(b) by 123 days.

(21) Appl. No.: 15/350,459

(22) Filed: Nov. 14, 2016

(65) Prior Publication Data

US 2017/0223814 A1 Aug. 3, 2017

Related U.S. Application Data

(60) Provisional application No. 62/254,376, filed on Nov. 12, 2015, provisional application No. 62/254,360, filed on Nov. 12, 2015.

(51) Int. Cl.

| | |
|---|---|
| ***H05G 1/00*** | (2006.01) |
| ***H05G 1/54*** | (2006.01) |
| ***H05G 1/34*** | (2006.01) |

(52) U.S. Cl.

CPC ..... *H05G 1/54* (2013.01); *H05G 1/34* (2013.01)

(58) Field of Classification Search

CPC ..... H05G 1/34

See application file for complete search history.

(56) References Cited

U.S. PATENT DOCUMENTS 2,490,140 A 4/1946 Ledeboer
2,512,193 A 6/1950 Zavales
(Continued)

FOREIGN PATENT DOCUMENTS

CN 204259267 8/2015
DE 3721591 1/1989
(Continued)

OTHER PUBLICATIONS

Rajwade, J., "Emission Control System for an X-ray Tube," Aug. 2001 (111 pages) http://academic.csuohio.edu/embedded/Publications/Thesis/JaisinghThesis.pdf.

Spellman High Voltage Electronics Corporation, "X-ray Generators & Monoblock X-ray Sources," Product Specifier, Nov. 2015 (4 pages) http://www.tminstruments.com.br/imagens/tm2/831.pdf.

(Continued)

*Primary Examiner* — Dani Fox

(74) *Attorney, Agent, or Firm* — Ware, Fressola, Maguire & Barber LLP

(57) ABSTRACT

An apparatus and method for actively managing the current provided to an X-ray filament is provided. A feedback measurement of the actual filament current supplied to an X-ray filament is provided into a current manager and feedback system. An error amplifier compares the feedback measurement to a filament reference command indicating the appropriate current amount to be supplied to the X-ray filament, and the output of the error amplifier runs a pulse width modulator to provide a signal to an inverter to supply a voltage to the X-ray filament transformer. When a comparator senses sufficient high voltage is supplied to the X-ray tube, a second error amplifier is allowed to add to the filament current command an amount sufficient to make the X-ray tube's emission current match the commanded emission current. Additional circuitry and electronic switches are provided to allow the apparatus to operate in a dual-filament system.

17 Claims, 2 Drawing Sheets

(56) References Cited

U.S. PATENT DOCUMENTS

| | | | | |
|---|---|---|---|---|
| 3,183,357 | A | 5/1965 | Phelan et al. | |
| 4,188,536 | A | 2/1980 | DallaPiazza | |
| 4,189,739 | A | 2/1980 | Copeland, III | |
| 4,311,913 | A | 1/1982 | Resnick et al. | |
| 4,571,667 | A | 2/1986 | Csorsz | |
| 4,590,603 | A | 5/1986 | Relihan et al. | |
| 4,603,310 | A | 7/1986 | Yarman | |
| 4,646,338 | A | 2/1987 | Skillicom | |
| 5,079,687 | A | 1/1992 | Sakisaka et al. | |
| 5,231,564 | A * | 7/1993 | Pellegrino ..... | H02M 7/103 363/61 |
| 5,335,161 | A | 8/1994 | Pellegrino et al. | |
| 5,602,897 | A | 2/1997 | Kociecki et al. | |
| 5,727,043 | A | 3/1998 | Watanabe | |
| 5,966,425 | A | 10/1999 | Beland | |
| 6,281,762 | B1 | 8/2001 | Nakao et al. | |
| 6,563,717 | B2 | 5/2003 | Lunding et al. | |
| 6,885,728 | B2 | 4/2005 | Hadland et al. | |
| 6,927,985 | B2 | 8/2005 | Klinkowstein | |
| 7,050,539 | B2 | 5/2006 | Loef et al. | |
| 7,366,283 | B2 | 4/2008 | Carlson et al. | |
| 7,448,802 | B2 | 11/2008 | Oettinger et al. | |
| 7,639,784 | B2 | 12/2009 | Feda | |
| 7,672,432 | B2 | 3/2010 | Bosello | |
| 7,787,593 | B2 | 8/2010 | Klein | |
| 7,852,986 | B2 | 12/2010 | Loef et al. | |
| 7,949,099 | B2 | 5/2011 | Klinkowstein et al. | |
| 8,487,534 | B2 | 7/2013 | Caiafa et al. | |
| 8,675,378 | B2 | 3/2014 | Beland | |
| 8,964,940 | B2 | 2/2015 | Caruso et al. | |
| 9,048,059 | B2 | 6/2015 | Jeong et al. | |
| 2011/0002446 | A1 | 1/2011 | Beland | |

FOREIGN PATENT DOCUMENTS

| | | |
|---|---|---|
| EP | 0146225 | 6/1985 |
| EP | 0228648 | 4/1998 |
| GB | 242946 | 1/1926 |
| GB | 1321896 | 7/1973 |
| GB | 2517671 | 4/2015 |
| JP | 2003257697 | 9/2003 |
| JP | 2010040809 | 2/2010 |
| KR | 101552318 | 9/2015 |

OTHER PUBLICATIONS

Spellman High Voltage Electronics Corporation, "uX 50W/65W/75W X-ray Generator," 2014 (5 pages) http://www.spellmanhv.com/sitecore modules/web/~/media/Files/Products/uX.ashx.

Charlton, E. E., et al. "An Oil-immersed X-ray Outfit for 500,000 Volts and an Oil-immersed Multi-section X-ray Tube." Radiology, vol. 29, Issue 3, p. 329 (Sep. 1937).

Hendricks, R. W. Abstract of "The ORNL 10-meter small angle X-ray scattering camera." Journal of Applied Crystallography, vol. 11, Issue 1, pp. 15-30 (1978).

Dumond, Jesse WM, and J. Paul Youtz, "The Thirty Kilowatt Continuous Input X-Ray Equipment and High Constant Voltage Generating Plant of the Watters Memorial Research Laboratory at the California Institute of Technology." Review of Scientific Instruments 8, pp. 291-307 (1937).

Schardt, Peter, et al., "New x-ray tube performance in computed tomography by introducing the rotating envelope tube technology." Medical Physics, vol. 31, Issue 9, pp. 2699-2706 (Sep. 2004).

* cited by examiner

METHOD AND APPARATUS FOR ACTIVE FILAMENT MANAGEMENT

CROSS-REFERENCE TO RELATED APPLICATIONS

The present application claims the benefit of U.S. Provisional Patent Application Nos. 62/254,360 and 62/254,376, both filed Nov. 12, 2015, which are incorporated by reference in their entirety.

FIELD OF THE INVENTION

The present invention relates to a method, apparatus and system for active filament management, preferably for use with X-ray tubes. A controlled current source ensures the tube filament is never overdriven—even on startup.

BACKGROUND OF THE INVENTION

A persistent problem in X-ray high voltage generators is the protocol for operating and protecting the filaments of very expensive X-ray tubes. In general, the operating current of the X-ray tube, and hence the quantity of X-ray flux generated, is controlled by the temperature of the tube filament. The higher the temperature, the more electrons are available for acceleration by the high voltage potential between the cathode and anode of the X-ray tube. The quantity of electrons per second is equivalent to the tube current as measured in milliamperes.

The filament temperature is controlled by varying the current supplied to the filament, generally measured in amperes. The higher the current, the higher the temperature and the more X-rays are produced.

Complicating the issue is the fact that the cathode and filament are usually at a very high negative potential with respect to ground potential, where the control electronics are located. This requires some sort of isolation through which the power to the filament is supplied. In the present invention this isolation is provided by a specially designed filament transformer.

SUMMARY OF THE INVENTION

The present invention addresses these shortcomings in the art by providing an apparatus and method for actively monitoring and regulating the current provided to an X-ray filament.

In accordance with the present invention, a feedback measurement of the actual filament current supplied to an X-ray filament is provided into a current manager and feedback system. An error amplifier is used to compare the feedback measurement to a filament reference command indicating the appropriate current amount to be supplied to the X-ray filament, and the output of the error amplifier runs a pulse width modulator to provide a signal to an inverter to supply the appropriate voltage to the X-ray filament transformer. Thus, the actual filament current is compared to a predetermined acceptable current amount, and an error signal is provided to bring the actual filament current to the predetermined current amount. This predetermined reference current amount can be a current amount for high voltage usage of the filament or an idle current amount for periods without a high voltage application. The present invention makes use of two servo loops: a filament current servo loop and an emission current servo loop.

The present invention provides several advantages over the prior art. For example, in most X-ray systems, a cable connects the high voltage power supply to the X-ray tube. In certain instances, this cable can have a length between ten and fifty feet. If this cable in an X-ray system is changed, then it requires recalibrating the entire system to ensure that a proper current is provided to the filament. The change in the cable can change the series resistance of the filament circuit, and because the current through a filament is a factor of the voltage and resistance, this change in resistance will change what the X-ray system believes to be the current passing through the filament, because the filament current is not monitored. In contrast, in the present invention, the series resistance of the filament circuit is less relevant because the current is managed to ensure that a constant current is being applied. As a result, if the X-ray tube or the cable between the X-ray tube and high voltage power supply are changed, the present invention allows the continued operation of the X-ray system without recalibration.

Furthermore, the present invention significantly improves the lifespan of the X-ray filament tube. When an X-ray tube filament is turned on, the initial current boost through the filament can be uncontrolled, damaging or decreasing the lifespan of the filament. In contrast, the present invention allows for the active management of the filament during both high voltage and idle usages. The present invention allows for the regulation of the current at a high voltage use by ensuring that the filament current does not exceed a threshold value. Further, the present invention allows for the regulation of the filament current during idle periods between high voltage usages to ensure that the filament current does not exceed an idle threshold value. This management of the filament current means that the X-ray equipment can safely remain on during and in between periods of high voltage use, and does not require repeatedly turning the equipment on and off, thereby damaging the X-ray tube filament.

In accordance with the present invention, an apparatus for managing current provided to an X-ray tube filament is provided. The apparatus comprises a filament current provider circuit configured to provide a voltage to implement an amount of current flow in a filament. The apparatus further comprises a current manager circuit configured to receive a first signal from the filament current provider circuit indicating the amount of current flow in the filament, compare the amount of current flow in the filament to a current command, and transmit a second signal to the filament current provider circuit, instructing the filament current provider circuit to modify the voltage provided to implement the current flow in the filament such that the current flow in the filament matches the current command.

In accordance with an embodiment of the apparatus of the invention, the apparatus further comprises a voltage supply, at least one filament transformer, and a filament rectifier circuit. The at least one filament transformer may comprise two filament transformers, each of the filament transformers for use with a different size of filament. The filament rectifier circuit may be a dual-filament rectifier circuit. The voltage supply comprises an insulated-gate bipolar transistor or metal oxide semiconductor field effect transistor inverter configured to provide voltage to the at least one filament transformer.

In accordance with a further embodiment of the apparatus of the invention, the current manager circuit comprises a current transformer, an error amplifier; and a pulse width modulator. A primary winding of the at least one filament transformer is configured to provide the first signal to a primary winding of the current transformer indicating the amount of current flow in the filament, and a secondary winding of the current transformer is configured to provide a feedback current signal based on the received first signal. The feedback current signal also indicates the amount of current flow in the filament. The current transformer may provide the feedback current signal to a bridge rectifier to convert the feedback current signal from alternating current to direct current. The feedback current signal is provided from the bridge rectifier to the error amplifier. The error amplifier is configured to receive the current command and compare the amount of current flow in the filament to the current command. Based on the comparison of the amount of current flow in the filament and the current command, the error amplifier provides an output signal to the pulse width modulator, and based on the output signal the pulse width modulator transmits the second signal to the voltage supply, instructing the voltage supply to supply a particular voltage to implement the current flow in the filament such that the current flow in the filament matches the current command.

In accordance with a further embodiment of the apparatus of the invention, the apparatus further comprises an emission current regulator configured to receive an emission current feedback signal and an emission current command, compare the emission current feedback signal and an emission current command, and output a command for additional filament current. The apparatus may further comprise a command summer configured to combine the emission current regulator output with an idle current command to output the current command to the error amplifier.

In accordance with a further embodiment of the apparatus of the invention, the apparatus may comprise a limiting circuit configured to compare the current command to a maximum filament current command and, if the current command exceeds the maximum filament current command, to limit the current command to the maximum filament current command. The apparatus may further comprise a time-delayed fault latch configured to shut down the pulse width modulator if the limiting circuit limits the current command for predetermined length of time.

In accordance with a further embodiment of the apparatus of the invention, the feedback current signal is provided from the bridge rectifier to an amplifier configured to amplify the feedback current signal for providing to an over load comparator, the over load comparator being configured to shut down the apparatus in the event of an over load.

In accordance with a further embodiment of the apparatus of the invention, the insulated-gate bipolar transistor or metal oxide semiconductor field effect transistor inverter comprises two inverters and wherein each of the two inverters is configured for use with a respective one of the two filament transformers and corresponding filament. The apparatus may further comprise an electronic switch configured to determine which of the two inverters is active at a given time.

In accordance with a further embodiment of the apparatus of the invention, the apparatus may further comprise one or more electronic switches configured to determine when the emission current regulator becomes active.

In accordance with a further embodiment of the apparatus of the invention, the apparatus may further comprise an electronic switch configured to determine the maximum filament current command.

DETAILED DESCRIPTION OF THE FIGURES

The present invention will now be described with reference made to FIGS. 1 and 2.

Figure 1:
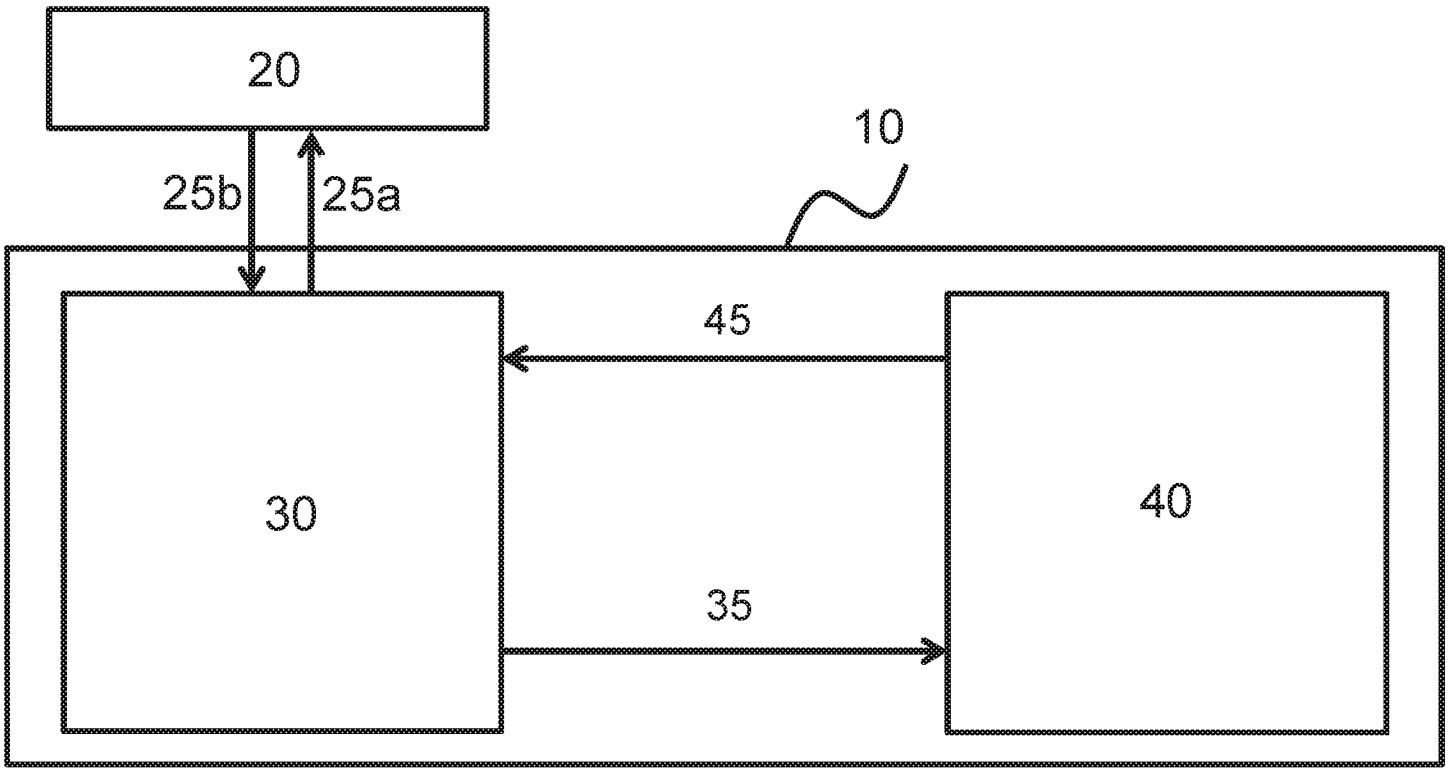
FIG. 1 shows a block diagram of a system and apparatus for actively managing the current in an X-ray tube filament, in accordance with the present invention.

In accordance with an embodiment of the present invention, a system is provided, including an apparatus 10, for actively managing the amount of current in an X-ray tube filament 20, as shown for example in FIG. 1

The apparatus 10 may include a filament current provider circuit 30, which is configured to supply via a line 25*a* a current to the X-ray tube filament 20. The filament current provider circuit 30 may include a voltage supply, one or more filament transformers and a rectifier circuit, as is described in further detail below in reference to FIG. 2. The voltage supply of the filament current provider circuit 30 supplies a voltage to the primary winding of the filament transformer, and is passed through a rectifier circuit for conversion from alternating current to direct current, and then supplied via line 25*a* to the filament 20.

The apparatus 10 further includes current manager circuits 40. The current manager circuits 40 are configured to actively manage the amount of current going through the filament 20. The current manager circuits 40 compare the current through the filament 20 to a reference current value and, if the actual filament current deviates from the reference current, then the current manager circuits 40 provide a current control signal along line 45 to instruct the filament current provider circuit 30 to modify the voltage signal applied for generation of the current through the filament 20.

Upon providing a current via line 25*a* to the filament 20, the filament current provider circuit 30 receives a reflected back filament current signal via a line 25*b*. This filament current signal serves as the basis of a feedback current used by the current manager circuit 40 to manage the filament current. A filament current provider feedback signal 35 contains information about the filament current and is sent from the filament current provider circuit 30 to the current manager circuits 40, which generates a feedback current signal. The feedback current signal may be generated by a current transformer in the current manager circuits 40, as discussed in greater detail below in reference to FIG. 2. The feedback current signal, which indicates the actual filament current, is compared to a reference current by the current manager circuits 40. If the feedback current signal is determined to deviate from the reference current, then a current control signal is provided via line 45 is to the filament current provider circuit 30, which instructs the filament current provider circuit 30 to modify the voltage signal applied for generation of the filament current, in order to bring the actual filament current into conformity with the reference current. In certain embodiments, such as the one shown in FIG. 2 and described below, the current manager may further include an error amplifier (also referred to as an operational amplifier or op-amp), which receives the reference current signal and the feedback current signal and performs the comparison, and a pulse width modulator, which receives an output from the error amplifier, and provides the current control signal via line 45 to the filament current provider circuit 30.

Figure 2:
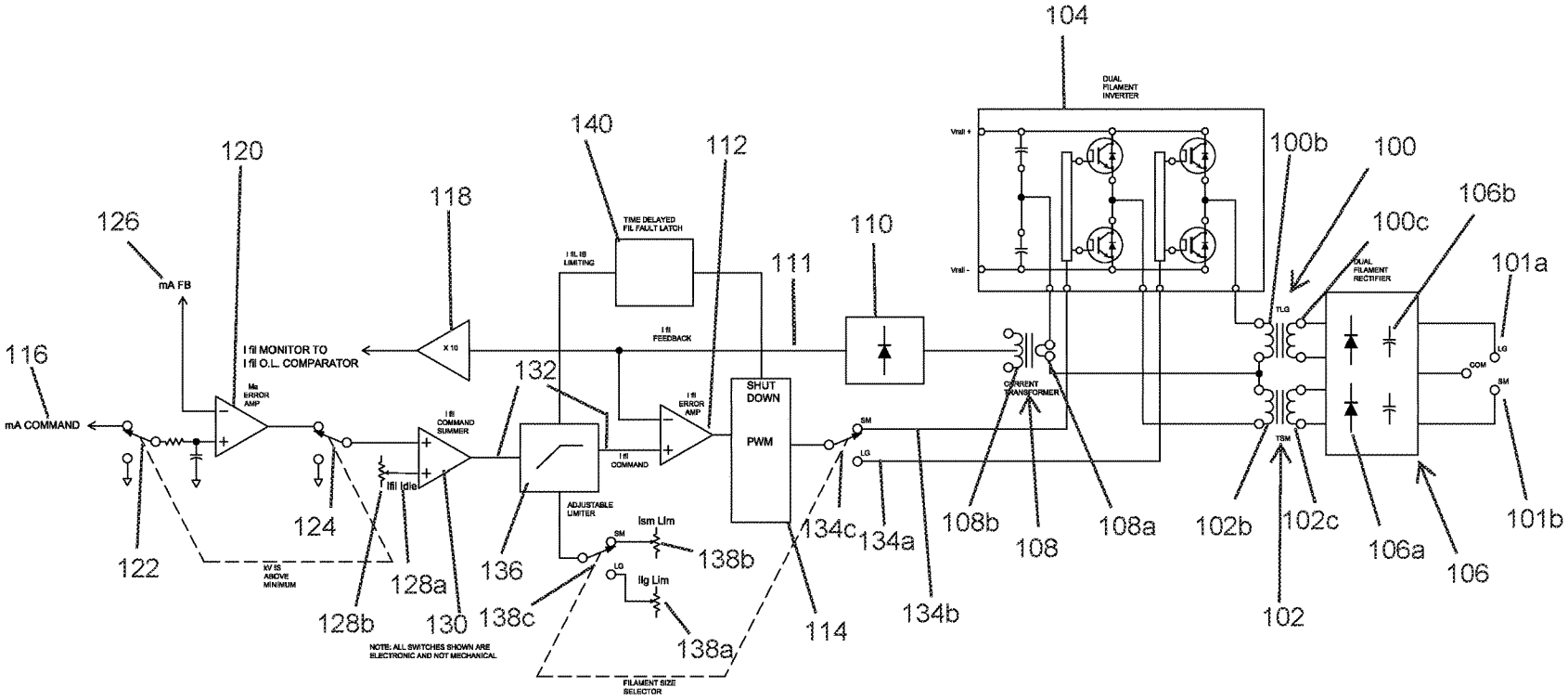
FIG. 2 shows a further block diagram of an embodiment of the apparatus of present invention.

A circuit diagram of an embodiment of the present invention is further shown in FIG. 2.

As previously described, in accordance with the present invention, a method and apparatus is provided for managing the current provided to the filament of an X-ray tube. The present invention may be configured for use with a large filament and a small filament. A first transformer 100 is provided, which provides a current supply via a terminal 101*a* to a large filament, and a second transformer 102 is provided, which provides a current supply via a terminal 101*b* to a small filament. The present invention is not limited to use with any particular type of transformer or transformer structure, but can incorporate any transformer known in the art suitable for the application. In certain embodiments, the filament transformers 100, 102 may take the form of cascaded filament transformers, as described in applicant's U.S. Provisional Patent Application No. 62/254,379, filed Nov. 12, 2015, which is hereby incorporated by reference in its entirety. During operation of the apparatus, only one filament, large or small, is in use at a given time, and in the circuit diagram of FIG. 2, the circuit would follow the path to either the large or small filament, and the associated circuit elements. Electrical switches, like element 134*c*, 138*c* may be employed to switch between the circuit elements 134*a*, 134*b*, 138*a* and 138*b* for the small or large filament.

The filament power is supplied to the primary winding 100*b*, 102*b* of the transformers 100, 102 by a high frequency insulated-gate bipolar transistor (IGBT) inverter 104. "High frequency", as used herein, may refer to a frequency in the tens of kilohertz, as would be understood by persons having ordinary skill in the art. The IGBT inverter 104 may include two independent half bridges, each with a gate drive circuit, as shown in FIG. 2, but in alternative embodiments, different configurations of the IGBT inverter 104 can be provided, including substituting a metal oxide semiconductor field effect transistor (MOSFET) for the IGBT inverter 104, without deviating from the scope of the present invention. The IGBT inverter 104 includes two inverters, only one of which is active at a given time. An electronic, or solid state, switch 134*c* determines a filament of the two small and large filaments, and sends gate pulses only to the selected inverter. The width of alternating polarity pulses supplied to the transformers 100, 102 modulates and controls the filament current. Narrower pulses having a lower duty cycle result in lower filament current and increasing pulse width increases the filament current.

At the secondary winding 100*c*, 102*c* of the transformers 100, 102, the alternating polarity pulses are rectified and filtered by a dual filament rectifier circuit 106, to produce a DC voltage and current, which is supplied via terminals 101*a*, 101*b* to the filament. The dual filament rectifier circuit 106 may include one or more rectifiers 106*a* and one or more capacitors 106*b*. The present invention is not limited to use with any particular combination of capacitors, rectifiers and/or other elements in the dual filament rectifier circuit 106, but can incorporate any combination known in the art suitable for the application. In certain embodiments, the dual filament rectifier circuit 106 may further include a CLC (capacitor-inductor-capacitor) filter.

For safety reasons, the high voltage is applied to the X-ray tube only when X-rays are actually needed. As a result, high voltage may be turned on and off many times in a day's operating period. As previously described, this kind of on-off activity can negatively impact filament lifetimes due to thermal and mechanical stresses. Thus, in accordance with the present invention, the filament supply is generally left on when the high voltage is off. To insure long filament life, the filament is operated at an intermediate temperature during the high voltage off times and the temperature is increased to operating levels only after high voltage has been turned on and achieved at least 10% of its final level. The filament current during this off time is called the IDLE current and is generally around half (or slightly less) the operating current.

In accordance with the present invention, the filament current is constantly regulated using the primary current of the filament transformers 100, 102 as feedback to an electronic servo loop, whereby the pulse width of inverter output is controlled by operational amplifiers and a pulse width modulator circuit to make the primary current match a current command.

Voltage from the IGBT inverter 104 is applied to the filament transformer 100, 102, which provides an alternating current (AC) voltage to the dual filament rectifier circuit 106. The dual filament rectifier circuit 106 converts the voltage to direct current (DC), and the DC voltage is provided via terminal 101*a*, 101*b* to the filament. The resistance of the particular filament determines the amount of current provided through the filament for the particular voltage applied. The current reflects back to the primary winding 100*b*, 102*b* of the filament transformer 100, 102, which is presented from the dual filament rectifier circuit 106 as a sine wave current. The primary current of the filament transformers 100, 102 accurately represents the actual current supply to the filament. The primary current of the filament transformer 100, 102 is supplied to the primary winding 108*a* of a current transformer 108.

The primary winding 108*a* of the current transformer 108 measures the current provided from the filament transformers 100, 102 and provides a feedback current signal from the secondary winding 108*b* along line 111, which is converted from alternating current to direct current by a bridge rectifier 110. As previously indicated, the feedback current signal provides a voltage that is proportional to the current supplied from terminal 101*a*, 101*b* to the filament. A connection from the primary winding 108*a* of the current transformer 108 is also provided to the IGBT inverter 104, to close the circuit with the filament transformers 100, 102. The two filament transformers 100, 102 share a common return path, by way of the current transformer 108.

The feedback current signal from line 111 is directed to two components. The feedback current signal is provided to an amplifier 118, which amplifies the feedback current signal, and provides the output to an over load comparator (not shown). In the event that the over load comparator detects that the filament is too hot, the entire system is shut off. The feedback current signal is also provided to an error amplifier 112. The error amplifier 112 compares the feedback current signal to an emission current command 116, and outputs a compared analog signal to a pulse width modulator 114, as discussed in greater detail below.

The high voltage current in the X-ray tube is referred to as emission current and only flows when high voltage is present. The present invention allows a separate emission current regulator (ECR) 120 to operate only when the presence of sufficient high voltage is sensed by a high voltage comparator (not shown) monitoring the high voltage output. The high voltage comparator drives one or more electronic switches 122, 124. When a sufficiently high voltage is detected by the high voltage comparator, an emission current command 116 from a controller is provided to the ECR 120. The ECR 120 additionally receives a further emission current feedback signal 126, which may be supplied by a shunt resistor on the bottom of the high voltage stack (not shown). The emission current feedback signal 126 provides a voltage proportional to the output current, and is reflective of the emission current in the X-ray tube. The ECR 120 is another operational amplifier servo loop whose output is a voltage added to the IDLE current command along line 128*a* by a command summer 130, when enabled by the high voltage comparator. The ECR 120 servo loop compares the emission current feedback signal 126 to a customer supplied emission current command 116 and increases the emission current command 116 as required to achieve the commanded emission current of emission feedback current signal 126. When there is not a sufficiently high voltage detected by the high voltage comparator, the switches 122, 124 are turned off and grounded, such that the only current being supplied to the error amplifier 112 is the IDLE current command supplied via line 128*a*.

The IDLE current command is generated by a potentiometer 128*b* located on the control PC board. In certain embodiments, the IDLE current potentiometer 128*b* and control PC board are only accessible to service personnel. The current command output of the ECR 120 is added to the IDLE current command supplied via line 128*a* by the command summer 130.

The resulting current command 132 is provided to an error amplifier 112, which compares the current command 132 to the feedback current signal provided from the current transformer 108 and bridge rectifier 110, as previously described. The error amplifier 112 ensures that the current command 132 matches the feedback current signal from line 111, which indicates the current amount supplied via terminal 101*a*, 101*b* to the filament. The output of the error amplifier 112 is provided to a pulse width modulator 114. The output signal from the pulse width modulator is provided along lines 134*a*, 134*b* from the pulse width modulator 114 to the IGBT inverter 104, which controls the voltage applied at the IGBT inverter 104 output to ensure that the proper voltage amount is provided to the selected primary winding 100*b*, or 102*b* of the filament transformer 100, or 102.

The system according to the present invention further incorporates one or more fail-safe mechanisms, to prevent an excess current or voltage application to the filament of the X-ray tube.

As a first fail-safe, an operational amplifier limiting circuit 136 limits the total filament current command 132 to a level determined to be safe for the X-ray tube being used. The maximum filament current command for a large filament is generated by a potentiometer 138*a*, and the maximum filament current command for a small filament is generated by a potentiometer 138*b*. An electrical switch 138*c* can be provided between the limiting circuit 136 and the potentiometers 138*a*, 138*b*, to switch between the large filament potentiometer 138*a* and small filament potentiometer 138*b*. The potentiometers 138*a*, 138*b* may be restricted in their access, so as to be only accessible to service personnel. The limiting circuit 136 ensures that the current command from the command summer 130 does not exceed that maximum filament current command for the filament.

A second fail-safe circuit is provided in the form of a time delayed fault latch 140. The fault latch 140 turns off the high voltage and filament power in the event the limiting circuit 136 is in operation for longer than a predetermined time. Generally, and by way of example, this period of time may be on the order of a half second to one second. In the event that the current command 132 exceeds the maximum filament current command for the predetermined period of time, the fault latch 140 shuts down the pulse width modulator 114, and the IGBT inverter 104 is therefore also shut down, cutting off the power to the filament transformer 100, or 102.

The accuracy and bandwidths of these various circuits have been designed to prevent the application of excessive current for excessive lengths of time to the X-ray tube filament, greatly extending its operating lifetime.

It should be understood that, unless stated otherwise herein, any of the features, characteristics, alternatives or modifications described regarding a particular embodiment herein may also be applied, used, or incorporated with any other embodiment described herein. Also, the drawings herein may not be not drawn to scale in whole or in part.

Although the invention has been described and illustrated with respect to exemplary embodiments thereof, the foregoing and various other additions and omissions may be made therein and thereto without departing from the spirit and scope of the present invention.

What is claimed:

1. An apparatus for managing current provided to an X-ray tube filament, comprising:

a filament current provider circuit configured to provide a voltage to implement an amount of current flow in a filament, the filament current provider circuit comprising:

a voltage supply, at least one filament transformer, and a filament rectifier circuit, wherein the at least one filament transformer comprises two filament transformers, each of the filament transformers for use with a different size of filament, and wherein the filament rectifier circuit is a dual-filament rectifier circuit; and a current manager circuit configured to:

receive a first signal from the filament current provider circuit indicating the amount of current flow in the filament;

compare the amount of current flow in the filament to a current command; and transmit a second signal to the filament current provider circuit, instructing the filament current provider circuit to modify the voltage provided to implement the current flow in the filament such that the current flow in the filament matches the current command.

2. The apparatus of claim 1, wherein the voltage supply comprises an insulated-gate bipolar transistor or metal oxide semiconductor field effect transistor inverter configured to provide voltage to the at least one filament transformer.

3. The apparatus of claim 1, wherein the current manager circuit comprises:

a current transformer;

an error amplifier; and a pulse width modulator.

4. The apparatus of claim 3, wherein a primary winding of the at least one filament transformer is configured to provide the first signal to a primary winding of the current transformer indicating the amount of current flow in the filament, and a secondary winding of the current transformer is configured to provide a feedback current signal based on the received first signal, the feedback current signal also indicating the amount of current flow in the filament.

5. The apparatus of claim 4, wherein the current transformer provides the feedback current signal to a bridge rectifier to convert the feedback current signal from alternating current to direct current.

6. The apparatus of claim 5, wherein the feedback current signal is provided from the bridge rectifier to the error amplifier.

7. The apparatus of claim 6, wherein the error amplifier is configured to receive the current command and compare the amount of current flow in the filament to the current command.

8. The apparatus of claim 7, wherein based on the comparison of the amount of current flow in the filament and the current command, the error amplifier provides an output signal to the pulse width modulator, and based on the output signal the pulse width modulator transmits the second signal to the voltage supply, instructing the voltage supply to supply a particular voltage to implement the current flow in the filament such that the current flow in the filament matches the current command.

9. The apparatus of claim 3, further comprising an emission current regulator configured to:

receive an emission current feedback signal and an emission current command;

compare the emission current feedback signal and the emission current command; and output a command for additional filament current.

10. The apparatus of claim 9, further comprising a command summer configured to combine the emission current regulator output with an idle current command to output the current command to the error amplifier.

11. The apparatus of claim 3, further comprising a limiting circuit configured to compare the current command to a maximum filament current command and, if the current command exceeds the maximum filament current command, to limit the current command to the maximum filament current command.

12. The apparatus of claim 11, further comprising a time-delayed fault latch configured to shut down the pulse width modulator if the limiting circuit limits the current command for predetermined length of time.

13. An apparatus for managing current provided to an X-ray tube filament comprising:

a filament current provider circuit configured to provide a voltage to implement an amount of current flow in a filament and comprising at least one filament transformer; and a current manager circuit configured to:

receive a first signal from the filament current provider circuit indicating the amount of current flow in the filament;

compare the amount of current flow in the filament to a current command; and transmit a second signal to the filament current provider circuit, instructing the filament current provider circuit to modify the voltage provided to implement the current flow in the filament such that the current flow in the filament matches the current command:

wherein the current manager circuit com rises a current transformer;

wherein a primary winding of the at least one filament transformer is configured amount of current flow in the filament, and a secondary ,winding of the current first signal, the feedback current signal also indicating the amount of current flow in the filament;

wherein the current transformer provides the feedback current signal to a bridge rectifier to convert the feedback current signal from alternating current to direct current: and wherein the feedback current signal is provided from the bridge rectifier to an amplifier configured to amplify the feedback current signal for providing to an over load comparator, the over load comparator being configured to shut down the apparatus in the event of an over load.

14. An apparatus for managing current provided to an X-ray tube filament, comprising:

a filament current provider circuit configured to provide a voltage to implement an amount of current flow in a filament and comprising two filament transformers; and a current manager circuit configured to:

receive a first signal from the filament current provider circuit indicating the amount of current flow in the filament;

compare the amount of current flow in the filament to a current command; and transmit a second signal to the filament current provider circuit, instructing the current flow in the filament such that the current flow in the filament matches the current command;

wherein the voltage supply comprises an insulated-gate bipolar transistor or metal oxide semiconductor field effect transistor inverter configured to provide voltage to the two filament transformers; and wherein the insulated-gate bipolar transistor or metal oxide semiconductor field effect transistor inverter comprises two inverters and wherein each of the two inverters is configured for use with a respective one of the two filament transformers and corresponding filament.

15. The apparatus of claim 14, further comprising an electronic switch configured to determine which of the two inverters is active at a given time.

16. The apparatus of claim 9, further comprising one or more electronic switches configured to determine when the emission current regulator becomes active.

17. The apparatus of claim 11, further comprising an electronic switch configured to determine the maximum filament current command.

* * * * *